165-82 SR
10/22/85 OR 4,548,261

United States Patent [19]
Case et al.

[11] Patent Number: 4,548,261
[45] Date of Patent: Oct. 22, 1985

[54] PLURALITY OF TUBULAR HEAT EXCHANGER MODULES

[75] Inventors: Michael A. Case, Scio; Glenn D. Mattison; Wayne S. Counterman, both of Wellsville, all of N.Y.

[73] Assignee: The Air Preheater Company, Inc., Wellsville, N.Y.

[21] Appl. No.: 609,397

[22] Filed: May 11, 1984

[51] Int. Cl.[4] ..... F28F 9/22; F28F 9/26
[52] U.S. Cl. ..... 165/82; 165/145
[58] Field of Search ..... 165/81, 82, 83, 145, 165/134, 144

[56] References Cited

U.S. PATENT DOCUMENTS

| | | | |
|---|---|---|---|
| 1,831,454 | 11/1931 | Kirgan | 165/83 |
| 3,227,209 | 1/1966 | Jacobs | 165/145 |
| 3,447,598 | 8/1969 | Kaess, Jr. | 165/82 X |
| 3,792,729 | 2/1974 | Perry | 165/176 X |
| 4,361,183 | 11/1982 | Ware et al. | 165/82 |

FOREIGN PATENT DOCUMENTS

| | | | |
|---|---|---|---|
| 3010699 | 10/1981 | Fed. Rep. of Germany | 165/82 |

*Primary Examiner*—Sheldon J. Richter
*Assistant Examiner*—Randolph A. Smith
*Attorney, Agent, or Firm*—William W. Habelt

[57] ABSTRACT

A recuperative tubular heat exchanger comprised of a plurality of tube-bundle heat exchange modules (20) stacked in a spaced array and interconnected by U-shaped, open-end header conduits (30) to form a serpentine flowpath through which a fluid to be heated is passed in heat exchange relationship with a heating fluid passing in cross flow over the tube bundle modules. The interconnected modules together with the header conduits form an integral assembly which is free to slide on support beams (26) so as to float within the housing (12) of the heat exchanger in response to the thermal deformation of the tube bundle modules.

1 Claim, 3 Drawing Figures

PLURALITY OF TUBULAR HEAT EXCHANGER MODULES

BACKGROUND OF THE INVENTION

The present invention relates to recuperative heat exchangers and, more particularly, to tubular heat exchangers of the type wherein a heating fluid is passed over a plurality of heat exchange tubes arranged in laterally adjacent modules interconnected to provide a serpentine flow path through which a fluid to be heated is passed in heat exchange relationship with the heating fluid.

In a typical recuperator heat exchanger of the type to which the invention pertains, a number of heat exchange modules are disposed in a spaced array, laterally adjacent to each other. Each heat exchange module comprises a plurality of longitudinally disposed tubes mounted at their opposite ends to apertured tube sheets. The laterally adjacent ends of neighboring modules are interconnected in fluid communication to form a serpentine flow path through which the fluid to be heated passes from module to module through the heat exchange tubes in heat exchange relationship with the heating fluid which is being passed in cross flow over the outside of the heat exchange tubes of the array of heat exchange modules.

As the heat exchange modules are disposed in series with respect to the flow of the heating fluid thereover, the temperature of the tubes of the module disposed at the hot end of the heat exchanger, i.e., at the end where the heating fluid enters the heat exchanger, will be higher than the temperature of the tubes of the module disposed at the cold end of the heat exchanger, i.e., at the end where the heating fluid leaves the heat exchanger. Accordingly, the axial elongation upon heating and the axial contraction upon cooling of the heat exchange tubes differs over the extent of the heat exchanger with the amount of thermal deformation decreasing in the direction of the flow of the heating gas flowing therethrough. Due to the presence of this differential thermal deformation along the axis of the heat exchange tubes, provision must be made for the exchange modules to expand longitudinally without interference from support apparatus or the heat exchanger housing.

One known method to accommodate the thermal deformation of a heat exchange module is to fixedly support one end of the module while slidably supporting the opposite end thereof and providing a flexible bellows seal between the end of the module which is free to move axially and the inlet duct to the module, such as disclosed in U.S. Pat. No. 2,653,779. The thermal deformation of each module is taken up by the bellows seal associated therewith. Such bellows seals, however, are subject to cycle fatigue causing cracking and tearing after repeated heating and cooling of the heat exchange modules.

Another known solution is disclosed in U.S. Pat. No. 2,965,358 wherein resilient moveable seals are provided between adjacent modules and also between each module and the entrance and exit ducts thereto. Thermal deformation is accommondated by moveable seals provided between sections of the heat exchanger which move relative to each other. The seals are arranged in guides to direct their movement. Such a seal system is necessarily quite complicated.

Accordingly, it is an object of the present invention to accommodate thermal deformation of laterally adjacent heat exchange modules without resorting to expansion joints or flexible seals as a means of accommodating such thermal deformation.

SUMMARY OF THE INVENTION

In accordance with the present invention, there is provided a recuperative tubular heat exchanger wherein thermal deformation of the heat exchange tube modules is accommodated by permitting the heat exchanger modules to freely float within the housing of the heat exchanger.

A plurality of heat exchanger modules are stacked in a spaced array within the housing of the heat exchanger. Each module comprises a pair of laterally spaced tube sheets having aligned apertures and a plurality of longitudinally disposed heat exchange tubes extending between the aligned apertures in the spaced apart tube sheets. A flow of a heating fluid, such as hot flue gas, passes through the housing in cross flow over the tubes of the heat exchange modules through which a second fluid to be heated, such as air for combustion, is passed.

Each of the heat exchanger modules is supported on a pair of supports with a lateral edge of each tube sheet abutting, but not fixed thereto, so that the tube sheet is able to slide across the support beam as the heat exchange tubes of the module expand or contract along their longitudinal axis.

Header conduits interconnect the lateral ends of adjacent heat exchanger modules so as to permit the second fluid to flow along a serpentine flowpath through the tubes of one module and thence through the tubes of the next adjacent module in heat exchange relationship with the first fluid flowing through the housing. Each header conduit is substantially U-shaped and is rigidly attached at its open ends to the tube sheets of the adjacent modules it interconnects. Each header conduit is spaced from the housing and the support beam it neighbors so as to provide expansion gaps along each side of the header conduit. As the heat exchange tubes of each module expand or contract, the tube sheets of the module will slide in a longitudinal direction in response thereto and the header conduit associated with each tube sheet will also move. As there is provided a gap on each side of each header conduit, the header conduits can move with their associated heat exchanger modules without interference from the support beams or the heat exchange housing. Thus, the heat exchanger modules are free to float in response to the thermal deformation of the heat exchange tubes.

DETAILED DESCRIPTION OF THE PREFERRED EMBODIMENT

Figure 1:
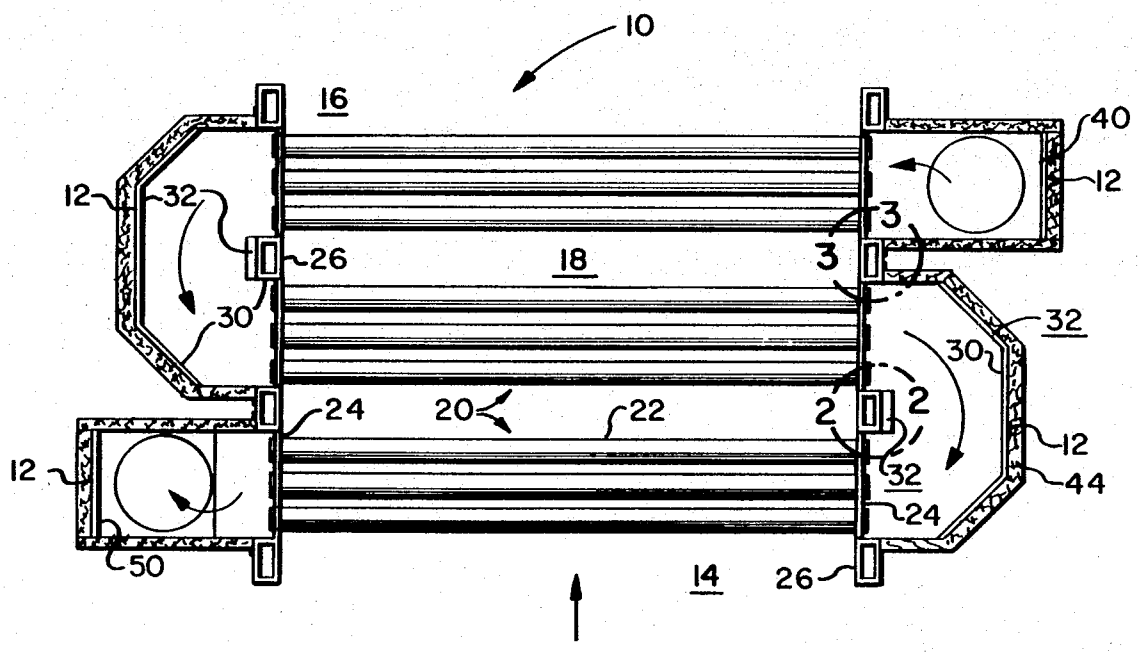
FIG. 1 is a sectional side elevation view of a recuperative heat exchanger embodying freely floating heat exchanger modules in accordance with the present invention.

Referring now to FIG. 1, there is depicted therein a tubular recuperative heat exchanger 10 having a housing 12 with a first opening 14 at the bottom thereof and a second opening 16 at the top thereof and defining therebetween a chamber 18 wherein a plurality of heat exchanger modules 20 are disposed in a vertical array. A heating fluid, such as hot flue gas, flows vertically upwardly or downwardly through the housing 12 between the first and second openings thereto and in doing so traverses the heat exchanger modules 20 disposed therein. Although shown and described herein with reference to a heat exchanger having vertically directed cross flow of gas over a vertical array of horizontally disposed heat exchange modules, it is to be understood that the present invention may also be applied to a heat exchanger having horizontally directed cross flow of gas over a horizontal array of vertically disposed heat exchange modules.

Each of the heat exchange modules 20 comprises a plurality of heat exchange tubes 22 disposed horizontally so as to extend between a pair of laterally spaced tube sheets 24. The paired tube sheets 24 are each apertured with a plurality of aligned openings adapted to receive in sealed relationship opposite ends of the heat exchange tubes 22. Each of the heat exchange modules 20 are supported on beams 26 which extend transversely across the housing 12 beneath the lower lateral edge of each tube sheet 24. The support beams 26 are connected to a structural framework not shown.

Laterally adjacent heat exchanger modules 20 are interconnected by header conduits 30 to permit a second fluid to be heated, such as air for combustion, to flow along a serpentine flowpath first through the heat exchange tubes of one module and thence through the heat exchange tubes of the next adjacent module and so on. An inlet duct 40 and an outlet duct 50 are provided to the housing 12, one opening to the uppermost heat exchanger module and the other to the lowermost heat exchanger module. The second fluid to be heated enters through the inlet duct 40 and exits through the outlet duct 50 after passing through the serpentine flowpath formed by the heat exchanger modules 20 and the header conduits 30 in heat exchange relationship with the heating fluid passing over the heat exchange tubes 22 of the modules 20.

The heat exchange tubes and the paired tube sheets from which they are supported form an integral structure, i.e., the heat exchanger module. Therefore, as the heat exchange tubes 22 expand as they heat up or contract as they cool down, the tube sheets 24 associated therewith will also want to correspondingly expand or contract. Additionally, the various heat exchanger modules 20 disposed in a vertical array are subject to differing fluid temperatures as the modules are disposed in series with respect to the flow of heating fluid. The tubes of the module disposed nearest the inlet for heating fluid to the housing 12 will experience the highest temperatures, while the tubes of the module disposed nearest the outlet for heating fluid from the housing 12 will experience the lowest temperatures. Therefore, the thermal deformation of adjacent heat exchange modules 20 will not be the same.

In accordance with the present invention, each heat exchange module 20 is free to thermally deform and the differential deformation is accommodated by permitting the entire assembly of heat exchange modules 20 interconnected by header conduits 30 to freely float within the housing 12. Accordingly, as best seen in FIG. 1, each of the header conduits 30 which interconnect the heat exchange modules 20 comprises an open-ended, U-shaped duct which is spaced from the housing 12 and the support beam 26 it surrounds so as to provide a gap 32 on each side of the header conduit. As each heat exchanger modules 20 expands or contracts, the header conduit or conduits associated therewith may move in a horizontal direction without interference from the housing or the support beams because of the gaps 32 provided at the sides of each conduit.

Figure 3:
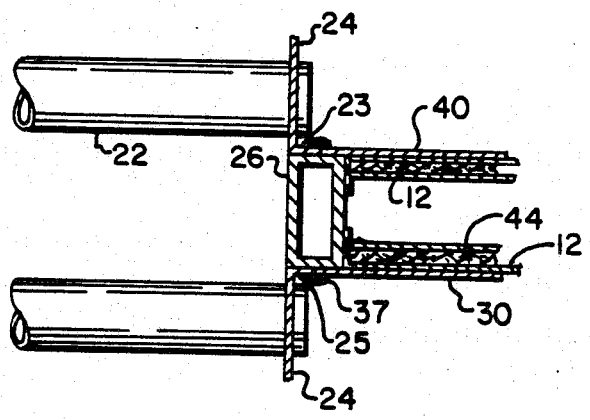
FIG. 3 is an enlarged sectional side elevation view of the region encircled by line 3—3 of FIG. 1.
Figure 2:
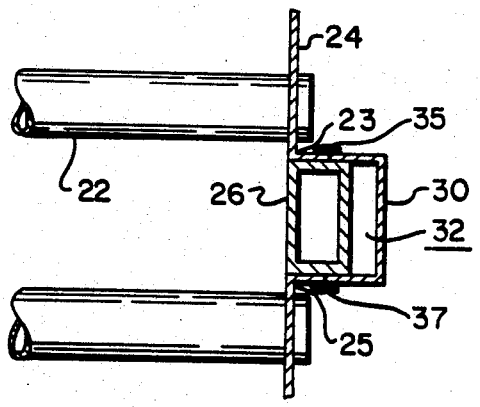
FIG. 2 is an enlarged sectional side elevation view of the region encircled by line 2—2 of FIG. 1.

The interconnection of a header conduit with its associated tube sheet is best seen in FIGS. 2 and 3. The lower lateral edges 23 of the tube sheets 24 rests upon the transverse support beams 26 as a means of supporting the heat exchanger modules 20. However, the lower lateral edges 23 of the tube sheets 24 are not attached to the support heams 26 upon which they rest. Rather, the lower lateral edges 23 of the tube sheets 24 are rigidly connected to the header conduits 30 such as by means of a seal weld 35 along the interface therebetween. Also, the upper lateral edges 25 of the tube sheets 24 are similarly interconnected, such as by seal welds 37, to the header conduits 30 along the interface between. In this manner, the header conduits 30 are made integral with the heat exchanger modules 20 they interconnect and the entire assembly is free to float within the housing 12 as the tube sheets 24 and header conduits 30 are free to slide across the support beams 26 as the heat exchange tubes expand and contract.

The inlet and outlet ducts 40, 50 for directing the second fluid through the serpentine flowpath formed by the interconnected heat exchange modules 20 and the header conduits 30 are similarly connected to a tube sheet of the uppermost and the lower most heat exchanger modules so that the inlet and outlet ducts may also float within the housing 12. The inlet and outlet ducts 40, 50 are also terminated short of the housing 12 so as to provide a gap therebetween into which the expansion of the header exchanger modules to which they are connected is accommodated.

The heat exchanger housing 12 may be insulated to protect personnel by providing a lining 44 of insulating material on the inside surface of the housing 12. However, there must still be provided a gap 32 between the insulated housing and the adjacent header conduit into which the header conduit may move without interference from the insulation when the heat exchange tubes of the heat exchanger modules associated therewith expand.

As described herein, the present invention provides a recuperative heat exchanger wherein tubular heat exchanger modules are free to float within the heat exchanger housing so as to accommodate differential tubular deformation between heat exchanger modules. It is to be understood that various modifications, some of which may have been alluded to herein, may be made to the specifically illustrated and described embodiment without departing from the spirit and scope of the present invention as defined in the claims recited hereinafter.

We claim:

1. A tubular heat exchanger including:

a. a housing having opposing ends, said housing having a first opening at the one end thereof and a second opening at the other end thereof and defining therebetween a chamber through which a vertical flow of a first fluid passes between the first and second openings in said housing;

b. a plurality of heat exchange modules disposed within said housing in a spaced vertical array, each module comprising a pair of laterally spaced tube sheets with aligned apertures therein and a plurality of longitudinally disposed heat exchange tubes extending between the aligned apertures in the spaced apart tube sheets;

c. a plurality of support beams disposed so as to extend transversely across and between the spaced heat exchange modules such that the tube sheets of each module have a lower lateral edge slidably abutting against a subadjacent support beam and an upper lateral edge slidably abutting against a superadjacent support beam;

d. inlet means to said housing for a second fluid at one end thereof and outlet means to said housing for the second fluid at the opposite end thereof, the inlet means and outlet means opening to the tubes of the upper-most heat exchange module and to the tubes of the lower-most heat exchange module; and e. header conduits interconnecting the lateral ends of vertically adjacent heat exchange modules to permit the second fluid to flow from the inlet means to the outlet means along a serpentine flow path through the tubes of one module and thence through the tubes of the next adjacent module in heat exchange relationship with the first fluid flowing through said housing, each header conduit comprising a substantially U-shaped open-ended duct rigidly attached to the tube sheets of the adjacent heat exchange modules that it interconnects and spaced from said housing and the support beams that it neighbors so as to provide a gap on each side of the header conduit into which the header conduit may contract or expand longitudinally as the tube sheets to which it is attached slide across the support beams which they abut.

* * * * *